US005359932A

United States Patent [19]

Van Breene

[11] Patent Number: 5,359,932

[45] Date of Patent: Nov. 1, 1994

[54] SELF-INKING HAND STAMPER WITH TILTED INKING PAD

[75] Inventor: Johannes M. Van Breene, Amersfoort, Netherlands

[73] Assignee: Louis Melind Co., Skokie, Ill.

[21] Appl. No.: 947,734

[22] Filed: Sep. 21, 1992

[51] Int. Cl.[5] ..... B41K 1/42

[52] U.S. Cl. ..... 101/334; 101/333; 101/104; 101/405

[58] Field of Search ..... 101/333, 334, 104, 35, 101/41, 42, 405

[56] References Cited

U.S. PATENT DOCUMENTS

| | | | |
|---|---|---|---|
| 4,013,007 | 3/1977 | Flynn | 101/333 |
| 4,805,529 | 2/1989 | Becher | 101/334 |
| 5,058,501 | 10/1991 | Skopek | 101/334 |
| 5,152,223 | 10/1992 | Mairon | 101/334 |

FOREIGN PATENT DOCUMENTS

| | | | |
|---|---|---|---|
| 0232014 | 2/1964 | Australia | 101/334 |

*Primary Examiner*—Edgar S. Burr
*Assistant Examiner*—Lynn D. Hendrickson
*Attorney, Agent, or Firm*—James W. Clement

[57] ABSTRACT

A self-inking hand stamper with an inking pad tilted from the horizontal. In moving from its retracted, inking position to its forward, stamping position, and back again, the die plate pivots around two pivot points to move through an arc of substantially less than 180°, resulting in a smaller stamper interior. The first pivot point is provided by a single pivot pin mounted on each side wall of the stamper, and slidably journaled in a single curved cam slot in the respective die plate support leg. The second pivot point is provided by the die plate axle, which is secured to the downwardly extending legs of the actuator yoke and is slidably journaled in a straight, vertical guide slot in the stamper frame.

20 Claims, 3 Drawing Sheets

SELF-INKING HAND STAMPER WITH TILTED INKING PAD

FIELD OF THE INVENTION

This invention relates to a self-inking hand stamper, and more particularly to one in which the ink pad is in a position that is tilted from the horizontal in order to make it possible to reduce both the vertical and the front-to-back horizontal dimensions of the stamper and to provide a smoothly operating stamper with a long life.

BACKGROUND OF THE INVENTION

Hand stampers that imprint information from a die onto a sheet of paper or other receiving surface have been used for a very long time. The concept of a self-inking hand stamper that includes a die plate that carries a die and can be pivoted by the user from its retracted, inking position to its forward, stamping position and back again is also very old. Many different types of such self-inking hand stampers have been known.

First Type

The earliest patent relating to a self-inking hand stamper that is known to applicant, Van Zandt No. 288,385 issued in 1883, shows the use on each side of the stamper of two sliding pivot points that make it possible for the die plate to pivot from its inking to its stamping position entirely within the space in the interior of the stamper. However, the construction of this stamper means that the die plate support legs protrude far outside that space, and that a very long stroke is required to operate the stamper.

One pivot point was provided by an axle located on a die plate support leg extending outward from the die plate, which axle slid up and down in a vertical guide slot in the stamper housing or frame. The second pivot point was provided by a pivot pin that was fixed to the housing or frame on each side thereof. Each pin was slidably journaled in a long, serpentine cam slot in the die plate support leg on its side of the housing or frame.

The external shape and length of each of the two die support legs were generally similar to the shape and length of the long, serpentine cam slot defined by the leg. As result, the die plate support legs protruded a very substantial distance outward beyond the boundaries of the space that extended from the inking pad directly down to the area occupied by the die plate its stamping position.

Second Type

A few years later, three patents to Hill, U.S. Pat. Nos. 315,286, 339,293 and Re. 10,740 issued Apr. 7, 1885, Apr. 6, 1886 and Jun. 29, 1886, respectively, introduced a feature that made it possible to contain the pivoting die plate entirely within the boundaries of the space immediately below the inking pad. However, this feature required the use of an extra cam slot, as well as an extra pivot pin fixed to the stamper housing or frame, on each side of the stamper, and still carried the die plate through a full 180° pivot before it came into contact with the inking pad.

More than 80 years later—in Lind U.S. Pat. No. 3,364,856 issued in 1968—the same operative concept was employed as in the Hill patents that were issued many years earlier. Thus the same extra cam slots and extra pivot pins were still needed.

Third Type

U.S. Pat. No. 3,216,352, issued to Schnaeckel in 1965, involved a hand stamper in which the die plate pivoted less than a full 180°. However, even though the pivot path followed by the die plate was only 90°, the movement of the pivoting die plate was rather complicated, and vertical space was saved only at the expense of requiring extra space in the front-to-back direction. Three cam slots were used on each side of the hand stamper to guide the axle and the outer end of each die plate support leg, each of which legs carried two pivot pins fixedly secured to the leg. The three cam slots were a horizontal slot and a vertical slot in the hand stamper housing or frame, and a slot positioned at an angle in each leg of the actuator yoke.

Becher U.S. Pat. No. 4,805,529, issued in 1989, relies on a still more complicated arrangement of parts to achieve a 90° pivoting of the die plate. Two embodiments are disclosed, both involving three camming members (two slots and a groove) on each side of the hand stamper.

Fourth Type

A fourth type of hand stamper that provides for pivoting of the die plate from its retracted, inking position to its forward, stamping position has been widely utilized for many years.

This type of hand stamper also has three camming members (either three slots or two slots and a groove) on each side of the stamper to guide the die plate as it pivots, but one of them is provided by a separate, elongated, pivotable camming member between the die plate support leg and the stamper housing side wall. Each of these separate camming members defines a cam slot that is straight at both ends but has an eccentric "hump" in the center portion of the slot. In addition, each separate camming member carries a pivot pin on its inner surface that is slidably journaled in a short, straight slot or groove in the die plate support leg. An axle about which the die plate can pivot (1) is located near the bottom end of the downwardly extending leg of the inverted yoke that carries an actuator handle, (2) is slidably journaled in a vertically oriented slot in each of the side walls of the hand stamper housing and (3) is slidably journaled in the above described cam slot in each separate, pivotable camming member as well.

Some examples of this fourth type of hand stamper are the self-inking stampers that have been sold under the trademarks "alpo MD," "Melcomarker," "alfa 3" and "2000 PLUS," respectively.

Still another example of this type of self-inking stamper, which has a separate, elongated, pivotable camming member with a cam slot that has an eccentric "hump" in its center portion, is provided by Weir et al. U.S. Pat. No. 4,970,954, issued in 1990.

Fifth Type

In a fifth type of prior art self-inking hand stamper that has also been widely utilized for many years, a cam slot that is vertical in its top and bottom portions with an eccentric "hump" in its central portion is defined by each side wall of the stamper housing or frame instead of by a separate camming member. Each of these side walls also provides two straight, vertical slots or ridges that guide the downwardly extending legs of the actuator yoke along a straight path in their downward and upward movement. A pivot pin attached to the inner surface of each of the side walls of the stamper housing or frame is slidably journaled in a short, straight groove on the outwardly facing side of each die plate support leg. The support leg axle is slidably journaled in the cam slot in the housing side wall, and also in a short, straight, horizontal cam slot in each of the legs of the actuator yoke.

In this fifth type of hand stamper, the separate pivotable camming members of the fourth type of hand stamper are omitted, but the side walls of the die plate housing or frame must include the three vertically oriented guide means described above, and the actuator yoke legs must include the associated horizontal guide slot.

An example of this type of self-inking hand stamper is the stamper sold for many years under the trademark "Justrite."

In another example of this fifth type of self-inking hand stamper, which has been publicly offered for sale (under the trademark "TRODAT") at least since 1985, the die plate is pivoted less than 180° from its forward, stamping position to its retracted, inking position, which is located at an angle of about 20° to the horizontal. However, because of the basic construction of this type of hand stamper, the angle of tilt of the inking pad could not be increased beyond the 20° just mentioned, without increasing the front-to-back dimension of the stamper by an unsatisfactory amount.

ADVANTAGES OF THIS INVENTION

The present invention avoids the disadvantages—which are (1) overly complicated mechanical structures and (2) the need for too much space within (and in some cases even outside) the stamper to accommodate the pivoting of the die plate and the die carried by it—that have been present in all the devices known in the prior art.

The die plate of the self-inking hand stamper of this invention is pivoted less than 180°, suitably about 135° to 155°. This is produced by tilting the inking pad at about 25° to about 45° from the horizontal. This shorter pivot path results in a very substantial savings in vertical space. At the same time, the use of two sliding pivot points makes it possible to decrease the front-to-back horizontal space occupied by the stamper.

As used in this specification and in the accompanying claims, the front of the hand stamper is considered to be the part that faces the user when the stamper is in use. The back of the stamper is the part that is facing away from the user when the stamper is in use.

An extremely simple and effective operating mechanism is provided by this invention. There is only one cam slot in each die plate support leg, as well as only one pivot pin on each side of the frame or housing of the stamper. In addition, the extra members required in the fourth type of prior art hand stamper—an internally positioned, pivotable camming member on each side of the stamper—is eliminated. Finally, the two guide slots for the actuator yoke that are located in each side wall of the housing or frame in the fifth type of prior art stamper, as well as the horizontal slots in the actuator yoke legs themselves in that embodiment, are eliminated.

Both the savings in space and the simplification of the operating mechanism of the hand stamper of this invention make it much more feasible to construct the stamper of plastic, which is important both as a design and a marketing matter.

SUMMARY OF THE INVENTION

The basic construction of the self-inking hand stamper of the present invention includes a die plate, with a support leg extending from each of its side edge portions, that is contained in a frame or housing in which the die plate can pivot from a retracted, inking position in the upper portion of the frame to a forward, stamping position at the base of the frame, and back again. Each of the side walls of the frame defines a vertically oriented guide slot.

An actuator having a handle and a downwardly extending yoke member is spring biased to hold the die plate in its retracted, inking position, in which position the die carried by the die plate contacts the inking means. Means is provided for guiding the actuator downward and upward as the handle is pushed down and then released, to move the die plate into its stamping position and back again to its inking position. Axle means is secured to each die plate support leg and to the downwardly extending yoke legs, and is slidably journaled in the vertically oriented guide slots in the frame side walls for vertical downward and upward movement.

The elements so far described are conventional. The improvement provided by the present invention comprises:

(1) positioning the axle means for the die plate support legs adjacent the die plate, with a base reference line extending from the center of the axle perpendicularly away from the die plate along each leg;

(2) fixedly securing a single pivot pin for each die plate support leg on the associated frame side wall, with the center of the pivot pin at a first predetermined distance from the longitudinal center line of the guide slot in the frame side wall, each pivot pin being spaced from the frame base a sufficient distance that the die plate and its support legs do not at any time protrude below a bottom opening in the frame base;

(3) providing a single cam slot in each die plate support leg, in which slot the pivot pin for that support leg is slidably journaled, with the outer end portion of the cam slot positioned adjacent the remote edge of the support leg and the inner end of the slot positioned adjacent the axle means for the support leg; and (4) tilting the inking means to bring the side opposite the pivot pins that are mounted on the frame side walls closer to the frame base, while keeping the tilted inking means spaced far enough from the pivot pins in the frame side walls that it will not impede the upward pivoting of the die plate and the die carried by the die plate.

As a result of this construction, the die plate—in moving either upward from its forward, stamping position at the base of the stamper frame to its retracted, inking position in the upper portion of the frame, or in the reverse direction—pivots through an arc of substantially less than 180°.

Various specific features of the invention are disclosed. The preferred positions of (1) the pivot pin mounted on each of the frame side walls, (2) the axle means and (3) the inking means are disclosed. The preferred perimeter of the die plate support legs is disclosed. Finally, several parameters and characteristics of the cam slot in each of the guide plate support legs are described.

BRIEF DESCRIPTION OF DRAWINGS

The invention will be further described by reference to the attached drawings, in which.

DESCRIPTION OF BEST MODE OF THE INVENTION

Figure 6:
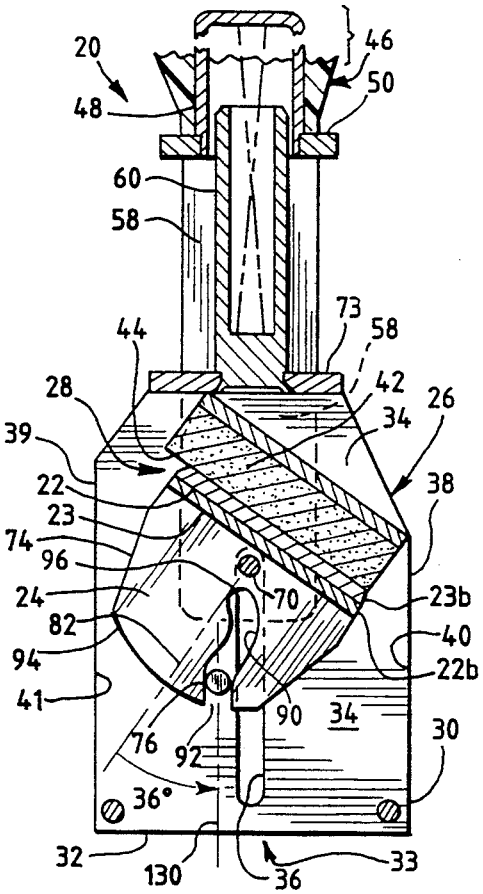
Figure 7:
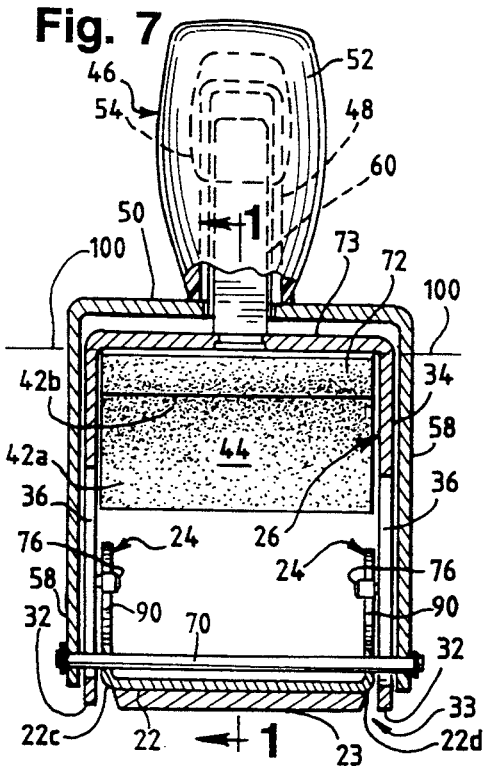
FIG. 7 is a cross-sectional view of the embodiment of FIG. 1, taken along the line 7—7 in the latter Figure.
Figure 8:
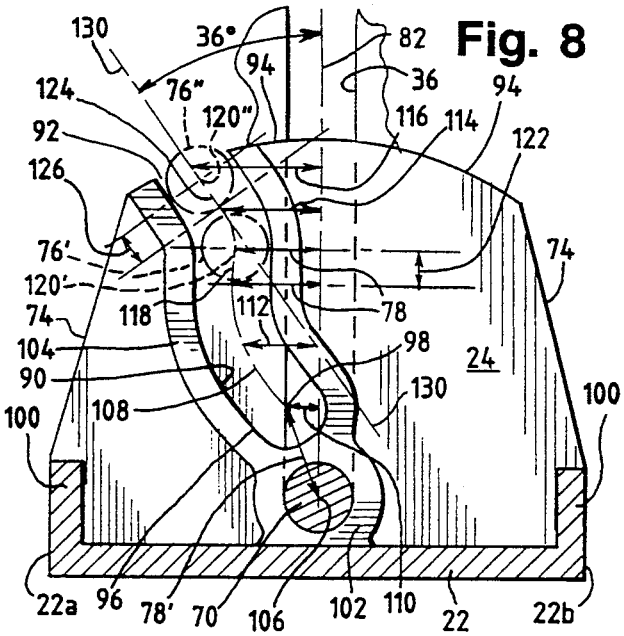
FIG. 8 is an enlarged view generally similar to the lower portion of FIG. 1, showing the shape of the cam slot in the die plate support leg of this embodiment in more detail.
Figure 9:
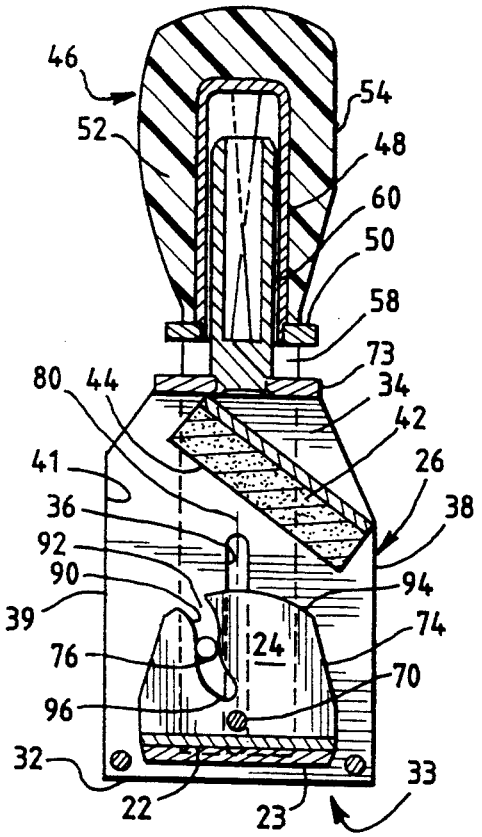
FIG. 9 is a cross-sectional view similar to FIG. 1, with the die plate and the die carried by it near the bottom of their pivot path, just before the handle of the stamper is pushed downward for the last part of its movement to bring the die into contact with the surface on which it will imprint the .information carried by the die.
Figure 10:
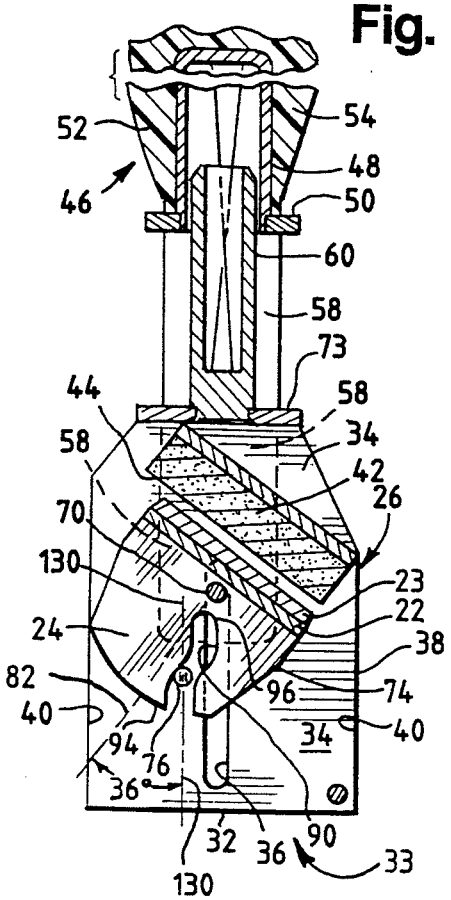
FIG. 10 is a cross-sectional view similar to FIG. 9, but with the die plate and die carried by it positioned near the top of their pivot path a short distance from the inking pad, just before the die plate and the die carried by it are moved straight upward to bring the die into contact with the inking pad.

FIGS. 1 through 10 of the accompanying drawing illustrate one embodiment of the self-inking hand stamper of this invention. The first seven of these Figures illustrate several positions through which the die plate and the die carried by it pivot as the die plate moves from its forward, stamping position to its retracted, inking position. FIGS. 8–10 show the cam slot in a die plate support leg, as well as the movement of the die plate at each end of its pivot path, in more detail.

Basic Construction of Hand Stamper Of This Invention

Figure 1:
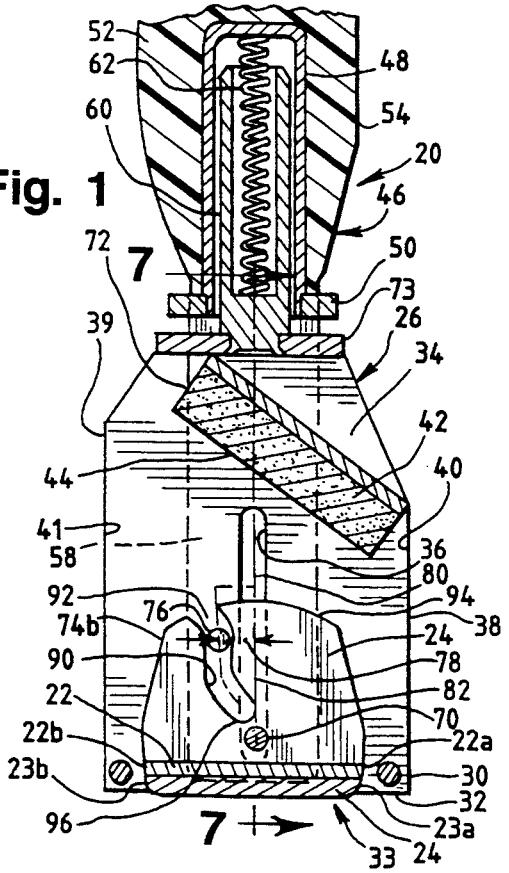
FIG. 1 is a cross-sectional view of one embodiment of the self-inking hand stamper of this invention, taken along a median plane perpendicular to the front and back of the stamper that is indicated by the line 1—1 in FIG. 7, which view shows the die plate in its forward, stamping position with the handle of the stamper pressed down to its lowest position and the die that is carried by the die plate just protruding from the opening in the base of the frame of the stamper.

The basic construction of the self-inking hand stamper 20 of the present invention includes die plate 22, which is seen in cross section in FIG. 1 taken along a median plane that bisects front edge 22*a* and back-edge 22*b* of the die plate, and thus bisects the front and back of the stamper as well. Support leg 24 seen in FIG. 1 extends, from a location adjacent the remote side edge of the die plate, at right angles to the die plate. A second support leg extends, of course, from adjacent the near side edge of die plate 22 to parallel the support leg 24 that is seen in this Figure.

Die plate 22 carries die 23, which contains information to be transferred onto a predetermined surface by stamping the information thereon when the hand stamper is placed on that surface and actuated by the user.

Frame 26 contains die plate 22—and die 23 carried by it—in both the retracted, inking position 28 shown in FIG. 6 and in the forward, stamping position at base 30 of frame 26 shown in FIG. 1. Bottom 32 of frame base 30 defines a planar opening 33 through which die 23 can contact the predetermined surface on which information is to be stamped. Frame 26 has two vertical side walls 34. The remote side wall 34 is seen in FIG. 1. Each side wall 34 defines a single vertical guide slot 36. Each of these guide slots is associated with one of the die plate support legs 24. Side wall outer edges 38 and 39 define front boundary plane 40 and back boundary plane 41, respectively, for frame 26.

Ink-absorbent pad 42 is positioned within frame 26 above die plate 22 and facing downward toward the die plate. In a conventional self-inking hand stamper, the outer surface 44 of pad 42 is horizontally positioned facing downward, so that when the die plate and the die it carries are pivoted from the forward, stamping position to the retracted, inking position, they move through a path of a full 180°. (In the hand stamper of the present invention, on the other hand, the inking pad is tilted from the horizontal, in a manner to be described below.)

Actuator 46 includes outer, hollow cylindrical member 48, which is attached to, and extends vertically upward from, yoke member 50. The actuator is completed by handle 52. A portion of the side of handle 52 at the front of the hand stamper provides a flat surface 54 to indicate to the user of the handle the proper orientation of the stamper as it imprints on the predetermined surface the information carried by die 23.

Yoke member 50 has a leg 58 extending downward outside frame 26 adjacent each side wall 34 of the frame. Inner cylinder 60, which is concentric with outer cylinder 48 of actuator 46, guides the actuator and the attached yoke member 50 alternately downward and upward, as handle 52 is pushed down by the user and then released.

A coil spring 62 seen in FIG. 1 and shown diagrammatically in FIGS. 2–6, 9 and 10, is housed within inner cylinder 60. At its bottom end, the coil spring engages the interior bottom wall of the inner cylinder, and at its top end it engages the interior top wall of concentric outer cylinder 48. Spring 62 biases actuator 46 in its uppermost position until handle 52 of the actuator is pushed downward by the user of the hand stamper.

Axle means 70 is operatively connected with each die plate support leg 24, and with each downwardly extending yoke leg 58 as well. In this embodiment, the axle is a single member extending fully across hand stamper 20 from one downwardly extending leg 58 of the yoke member to the other. Axle 70 is slidably journaled, for vertical downward and upward movement, in guide slots 36 in side walls 34 of frame 26.

The relationship of the elements just described can be seen from FIG. 7 as well as from FIGS. 1–6. In FIG. 7 the hand stamper of this invention is shown as seen in section along the surface indicated by line 7—7 in FIG. 1, which is for the most part the median plane that passes through the stamper parallel to front edge 22*a* and back edge 22*b* of die plate 22, but near its bottom end follows the center line of cam slot 36. Outer surface 44 of inking pad 42 is tilted toward the viewer in FIG. 7, and side wall 72 of the pad is tilted away from the viewer.

Die plate support legs 24 extend upwardly from adjacent each side edge portion 22*c* and 22*d* of die plate 22. Die 23 is carried by the die plate. As shown, each die plate support leg 24 is positioned adjacent a side wall 34 of frame 26. Top member 73 extends between side walls 34 to complete the frame for the stamper.

As already described above, actuator 46 includes an outer, hollow vertical cylindrical member 48 that is attached to and extends upward from yoke member 50. Inner, hollow, concentric cylinder 60 guides the actuator downward and upward as actuator handle 46 is pushed down and then released. A coil spring under compression (shown diagrammatically in FIG. 7) pushes against the interior bottom wall of inner cylinder 60 and against the interior top wall of outer cylinder 48 to bias actuator 46 in its uppermost position until handle 52 moves downward when pushed by the user of the stamper. The outline of flat surface 54 on actuator handle 52—which, as explained above, indicates the proper orientation of the hand stamper when it is in use—is shown by dashed lines at the far side of the handle as seen in FIG. 7.

The elements so far described are conventional. They are present in most, if not all, modern prior art hand stampers known to applicant. The additional elements of the self-inking hand stamper, which together with the elements thus far described comprise the hand stamper of this invention, are described below.

Pivot Points For Die Support Legs

The present invention utilizes vertically upward movement with simultaneous pivoting movement about two pivot points, for die plate 22, die 23 carried by it and the two die support legs 24. As shown in various Figures, one pivot point is supplied by axle 70, positioned between side edges 74 of each support leg 24, adjacent die plate 22. This axle 70, as explained above, is slidably journaled in guide slots 36 in frame side walls 26.

Axle 70 is preferably positioned immediately adjacent the back surface of the die plate, i.e., the surface to which the axle is attached. If it is structurally feasible its axis may even be located within the space occupied by the die plate, but it is preferred that no part of the axle itself should extend beyond the plane of the surface of the die plate to which the die is attached.

The second pivot point about which each die plate support leg 24 pivots as the die plate moves from its forward, stamping position to its retracted, inking position within frame 26 is provided by pivot pins 76. Each pivot pin 76 is a single pin fixedly secured to the frame side wall 34 with which the die plate support leg in question is associated. Pivot pin 76 has a circular cross section.

The center of pin 76 is spaced laterally a first predetermined distance 78 (see FIGS. 1 and 3) from the longitudinal center line 80 of the vertical guide slot 36 in frame side wall 34. In addition, each pivot pin 76 is spaced from bottom 32 of frame base 30 a sufficient distance that die plate 22 and its support legs 24 and the die carried by the die plate—as they pivot upward from the forward, stamping position of the die plate towards its retracted, inking position—do not at any time protrude substantially outward through planar opening 33 that is defined by the frame base.

In the embodiment shown, pivot pin 76 is located near the midsection of vertical guide slot 36 in frame side wall 34. Typically, each pivot pin 76 is positioned at a somewhat shorter perpendicular distance from the bottom of the side wall on which it is mounted than it is spaced from the outer surface 44 of inking pad 42.

It is preferable that the first predetermined distance 78 just mentioned not be too small. It should be large enough that the land area lying between pivot pin 76 and guide slot 36 has sufficient strength to provide a secure, durable base for the pivoting mechanism of the hand stamper of this invention. On the other hand, this first predetermined distance can not be too large, or two undesirable results may follow. First, if pivot pin 76 is located too far from center line 80 of the guide slot, axle 70 may jam as it moves up and down. Second, while the land area mentioned must be strong, it should also be as narrow as it can be made consistent with the strength requirement so that the pivoting action of die plate 22 and its associated members (see FIG. 3) will be as compact as possible. The more compact this pivoting action is, the narrower side walls 34 of frame 26 can be.

Upward Pivoting Of Die Plate, Die And Support Legs

The upward pivoting of die plate 22, die 23 and die plate support legs 24 simultaneously about pivot points 70 and 76 is illustrated in FIGS. 2 through 7. This pivoting is accomplished by the slidable journaling of the pivot points in guide slot 36 in frame side wall 74 and cam slot 90 in die plate support leg 24, respectively, and only in those slots. Outer end portion 92 of cam slot 90 is located at or near remote edge 94 of support leg 24, and its inner end is located adjacent axle 70 for the die plate support leg. Cam slot 90 is curved in outline for at least the major part of its length.

Figure 2:
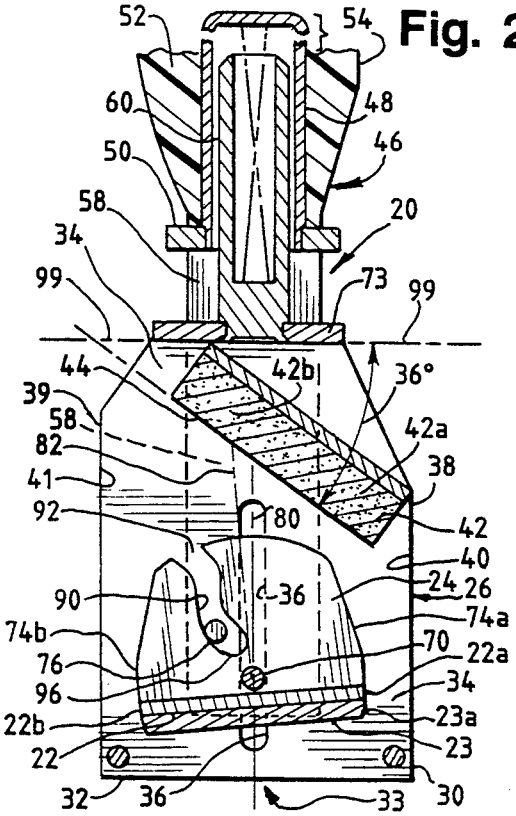
FIGS. 2 through 6 are similar views of the embodiment of FIG. 1, in which the handle of the stamper is raised into successively higher positions to cause the die plate to move upward and at the same time to pivot in a counterclockwise direction as seen in these Figures until the die plate is in its retracted, inking position and the die carried by the die plate is in contact with the inking pad.

As best seen in FIG. 2, in this embodiment downwardly facing surface 44 of inking pad 42 is in a position tilted from plane 99—which is parallel to planar opening 33 defined by bottom 32 of frame base 30—at an angle of about 36°. This brings portion 42*a* of inking pad 42 that is on the opposite side of guide slot 36 from pivot pin 76 on side wall 34 of frame 26 closer to frame base 30 than is the other portion 42*b* of inking pad 42.

In response to the action of compressed coil spring 62, when the user of the stamper removes the downward pressure of his or her hand from actuator handle 52, die plate 22 begins its upward movement. In the position of die plate 22 shown in FIG. 2, the die plate and die 23 carried by it have pivoted only a few degrees from the horizontal. At the same time, it should be noted that base reference line 82, which extends from the center of axle 70 perpendicularly away from die plate 22 along die plate support leg 24, has pivoted the same number of degrees away from the vertical center line 80 of guide slot 36. As axle 70 has moved vertically upward in guide slot 36 in frame side wall 34, cam slot 90 has simultaneously moved upward with respect to pivot pin 76—or, to put it another way, pivot pin 76 has moved in a relative sense downward in cam slot 90.

Figure 3:
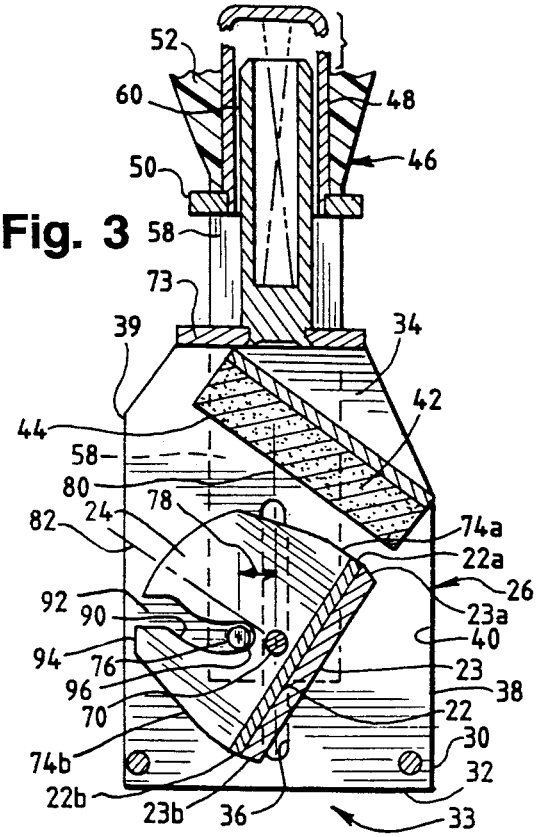

In FIG. 3, die plate 22, die 23 and die plate support legs 24 have pivoted substantially farther from the horizontal and at the same time have moved up towards inking pad 42. Base reference line 82 has pivoted counterclockwise an equivalent angular distance from center line 80 of vertical guide slot 36 in frame side wall 34. As will be seen, axle 70 has moved vertically upward in FIG. 3 until it is very nearly opposite pivot pin 76. At this juncture in the upward pivoting of the die plate and its associated members, it is apparent that edges 22*a* of die plate 22 and 23*a* of die 23, as well as side edge 74 of die support leg 24, will not protrude downward through planar opening 33 as the pivoting motion continues, since axle 70 will continue its upward movement in response to the action of coil spring 62. In other words, pivot pin 76 is spaced a sufficient distance from frame base 30 that any such protrusion has been avoided. At this point, back edges 22*b* of die plate 22 and 23*b* of die 23 are approaching outer surface 44 of inking pad 42, but have not yet reached that area.

Figure 4:
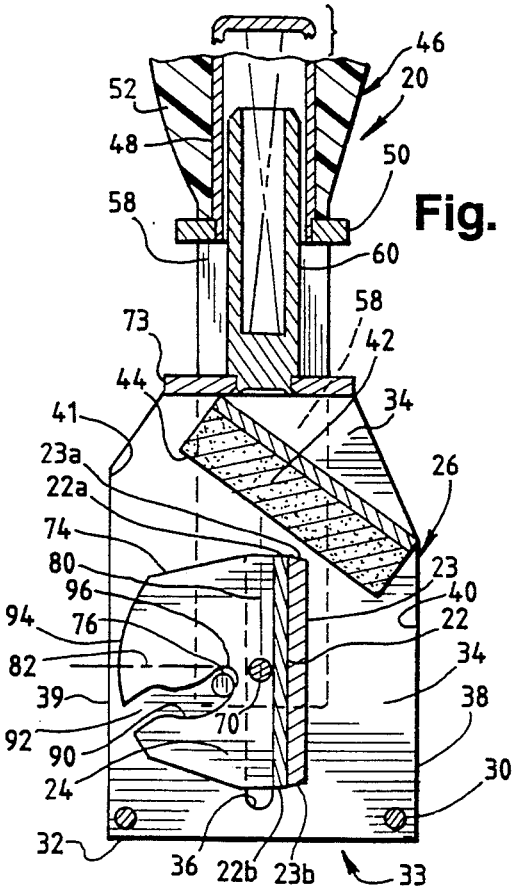
Figure 5:
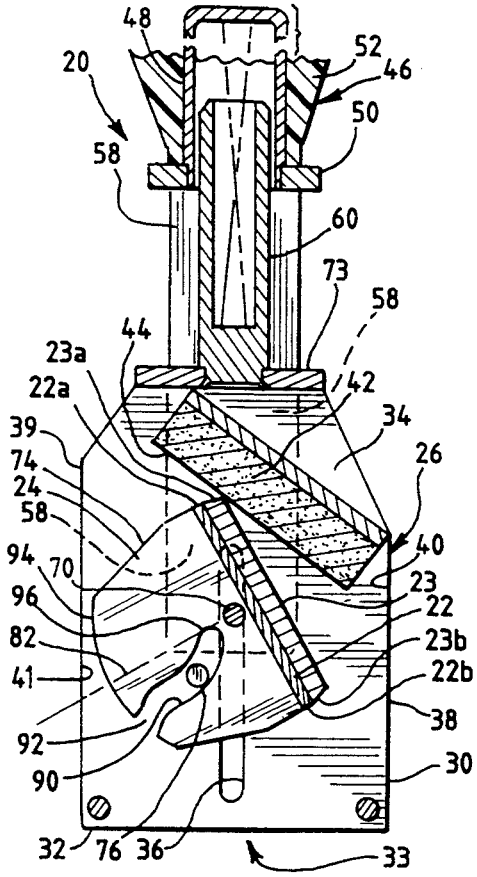

FIGS. 4, 5 and 6 show that as actuator 46 is moved farther upward by the action of coil spring 62, axle 70, which is secured to downwardly extending yoke legs 58, will take die plate 22, die 23 and edges 74 of die plate support leg 24 farther away from planar opening 33 formed by bottom 32 of frame base 30. By the same token, the vertically upward movement of axle 70 brings edges 22*b* of die plate 22 and 23*b* of die 23 closer to outer surface 44 of inking pad 42.

At the same time that the upward vertical movement of axle 70 moves die plate 22 and its associated members closer to inking pad 42, the sliding journaling of pivot pin 76 in cam slot 90 of die plate support leg 24 causes those members to rotate sufficiently (see FIGS. 4 and 5) that their upward pivoting movement is not impeded by the inking pad. In FIG. 6, die 22 is shown in contact throughout its outer surface with outer surface 44 of the inking pad.

As will be seen, in moving from its forward, stamping position at the base of frame base 30 to its retracted, inking position in the upper portion of the frame, die plate 22 pivots through an arc of substantially less than 180°. In the embodiment shown in FIGS. 2–6, since as mentioned above the outer surface 44 of inking pad 42 is tilted at about 36° from horizontal plane 98, die plate 22 pivots through an arc of about 144° in moving from its position shown in FIG. 1 to its position shown in FIG. 6.

As already indicated above, the savings in both vertical and horizontal space that results from the use of a die plate pivot path of substantially less than 180° and the accompanying simplification of the operating mechanism of the hand stamper of this invention make it significantly more feasible to manufacture the stamper out of plastic. This results in substantial savings in production costs, as well as important marketing advantages.

Location Of Certain Elements

FIGS. 2 and 3 show that axle 70 moves upward in guide slot 36 at a noticeably greater rate of speed than die plate edge 22*a* and die edge 23*a* move downward toward planar opening 33. As a result, when the die plate and the die it carries continue to pivot upward, edges 22*a* and 23*a* clear the bottom of frame 26 by a considerable amount.

If it is desired to lower the position of inking pad 42 and thereby reduce the vertical dimension of the hand stamper as much as possible, pivot pin 76 could be positioned on frame side wall 34 somewhat closer to the bottom of the frame, to locate it substantially as close to planar opening 33 as it can be without causing the die plate or its support legs to protrude through that planar opening. Even then, the pivot pin should not be positioned so low that no margin of safety is provided for a situation in which a die that is thicker than usual might tend to scrape across the surface being stamped when the handle of the stamper is released before the stamper is lifted off that surface.

In the embodiment shown, vertical guide slot 36 is located at the lateral mid-point of each side wall 34 of frame 26. This of course positions axle 70 similarly at the mid-point between the front and back edges of each frame side wall 34. As can be seen from FIGS. 3–6, it is desirable that the distance from the center of axle 70 to any point on the two side edges 74*a* and 74*b*, and on the third edge 94 as well, of each die plate support leg 24 be less than one-half the width of each side wall 34 of frame 26. This will ensure that no part of the support legs breaks through at any time either the front boundary plane 40 or the back boundary plane 41 defined by edges 38 and 39, respectively, of the frame side walls.

As will be seen from FIGS. 2 and 3, in order to avoid protruding through planar opening 33, it is also desirable that no part of side edge 74*b* of die plate support leg 24 extend substantially farther laterally of the die plate than back edge 22*b* of the die support leg. Similarly, in order to avoid bumping into inking pad 42, it is desirable that no part of side edge 74*a* of die support leg 24 extend substantially farther laterally of the die plate than back edge 22*a* of the die plate with which the support leg is associated.

Again, to conserve vertical space in the hand stamper, inking pad 42 should be located substantially as close to pivot pins 76 as it can be without impeding die plate 22, die 23 carried by it and die plate support legs 74 as they pivot upward from the forward, stamping position of the die plate toward the retracted, inking position of the die plate. As shown in FIGS. 4 and 5 in the embodiment illustrated, inking pad 42 is located about as close to pivot pin 76 as it can be without impeding the pivoting action being described.

More Detailed Description Of Cam Slot In Die Plate Support Legs

The outline of cam slot 90 in die plate support leg 24 can best be understood by reference to FIG. 8 of the drawing, which is an enlarged view generally similar to the lower portion of the cross-sectional view shown in FIG. 1. FIG. 8 shows die plate 22, die plate support leg 24, the lower portion of vertical guide slot 36, base reference line 82 extending perpendicularly away from die plate 22, and cam slot 90.

In this drawing, die plate 22 includes strengthening flanges 100 at both its front edge 22*a* and back edge 22*b*. Strengthening flange 102 surrounds the opening for axle 70, and strengthening flange 104 extends around the opening that comprises cam slot 90. Frame side wall 34, downwardly extending leg 58 of yoke 50, inking pad 42 and actuator 46 are omitted from this Figure for clarity.

In the position of die plate support leg 24 shown in FIG. 8, base reference line 82, which at all times is perpendicular to die plate 22, extends vertically upward from center 106 of axle 70. As has been seen in FIGS. 2–6, this base reference line will move counterclockwise as the die plate pivots upward. In the position shown in FIG. 8, base reference line 82 occupies a position that coincides with center line 80 of vertical guide slot 36.

The shape of cam slot 90 can be best described by reference to its center line 108. The bottom portion 96 of cam slot 90 in each die plate support leg 24 is arcuate in outline. It is preferred that the distance 78' between the center of curvature 98 of this arcuate bottom portion and center 106 of axle 70 (see FIG. 8) for die plate support legs 24 be approximately equal to the first predetermined distance 78 defined above (see FIG. 3), which is the distance between the center of pivot pin 76 on frame side wall 34 and the longitudinal center line 80 of guide slot 36 in the frame side wall. Distance 78' can be made somewhat shorter, but not so much as to weaken die support leg 24 in which the cam slot is located. Distance 78' can not be substantially longer, for the walls of the cam slot would then jam with pivot pin 76 before the pivoting die plate and its support legs reached the position shown in FIG. 3 in their upward movement from the forward, stamping position.

As one moves away from bottom portion 96 of cam slot 90 toward outer end portion 92 of the cam slot adjacent remote edge 94 of die plate support leg 24, the distance between the cam slot center line 108 and base reference line 82 increases for the major part of the length of the cam slot. Thus, in FIG. 8 distance 110 increases to distance 112, and beyond that to first predetermined distance 78. After being constant at distance 78 for a relatively small segment 118 of the cam slot center line, the distance between the center line and base reference line 82 increases to distance 114, and thereafter to distance 116.

Segment 118 of center line 108 of cam slot 90 is a straight line segment that is positioned at all times perpendicularly to die plate 22. In FIG. 8, as in FIG. 1, die plate 22 is shown in its forward, stamping position. When the die plate is in this position, center 120' of pivot pin 76' (which is shown in phantom in FIG. 8) lies approximately at the outer end of straight segment 118 of center line 108. Segment 118 extends from its inner end to its outer end for second predetermined distance 122. This ensures that when die plate 22 moves upward from its position in FIG. 8, it will be guided by axle 70 and pivot pin 76 to move straight up for a distance in the vertical direction. As will be explained below, the reverse is also true.

Straight line segment 118 should be long enough that it can accommodate dies of various thicknesses. Dies for use in self-inking hand stampers are made by manufacturers located in many countries, and these manufacturers make such dies in various thicknesses. Most U.S. manufacturers make dies that are about 3.2 mm. in thickness, while those made in Europe may vary from 2 to 3 mm. in thickness.

In the embodiment illustrated, when the die plate is in its forward, stamping position center 106 of axle 70, center of curvature 98 of the bottom portion of the cam slot and center 120' of pivot pin 76' all lie on a straight line that connects the three points mentioned. This straight line relationship can be seen from FIG. 8, although the line itself is omitted for clarity.

As center line 108 of cam slot 90 continues in a generally outward path from die plate 22, it passes through a gradually curved segment until it reaches the point at which the distance between center line 108 and base reference line 82 has increased to distance 114, and from there on outward to form straight line segment 124. Straight line segment 124 lies at approximately 36° to base reference line 82. As will be noted, this angle is substantially equal to the angle at which outer surface 44 of inking pad 42 is tilted from a plane parallel to planar opening 33 defined by bottom 32 of base 30 of frame 26.

Straight line segment 124 of the cam slot center line extends for at least a third predetermined distance 126, and in the embodiment disclosed extends a little farther. As seen, it terminates at outer end portion 92 of the cam slot, when it is at distance 116 from base reference line 82. Third predetermined distance 126 may be approximately equal to the second predetermined distance 122 mentioned above. As with line segment 118, line segment 124 should be long enough to accomodate dies of various thicknesses that are used with the hand stamper.

When cam slot 90 is in the position indicated in FIG. 6, pivot pin 76 lies generally near the open remote end 92 of the cam slot. This general position of pivot pin 76 is shown in FIG. 8 at 76", with center 120" of the pivot pin located approximately at the outer end of straight line segment 124 of the cam slot.

As will be seen, in FIG. 8 straight line segments 118 and 124 of center line 108 of cam slot 90 have both been darkened for emphasis. The outlines of the cam slot opening lying on both sides of straight line segments 118 and 124 have likewise been darkened.

Results Of Straight Portions Of Cam Slots

The result produced at each end of the pivoting movement of die plate 22 by the arrangement of parts just described will now be explained.

Just before die plate 22 reaches its forward, stamping position, it moves from the position shown in FIG. 9 along a straight path, perpendicular to planar opening 33 at the frame bottom, for a distance equal to second predetermined distance 122. During the movement of die plate 22 from the position shown in FIG. 9 downward to the position shown in FIGS. 1 and 8, the plane of die plate 22 is maintained substantially parallel to planar opening 33 because, as just explained, segment 118 of cam slot center line 108 is a straight line positioned at all times perpendicular to the die plate. As a result, die 23 carried by die plate 22 approaches the surface on which information is to be stamped in an attitude substantially parallel to that surface.

The vertically downward movement of die plate 22 and die 23 carried by it that has just been described will be best understood by considering FIGS. 2, 9, 8 and 1 in that order. In FIG. 2, die plate 22 and die 23 carried by it can be considered to be pivoting downward (instead of upward as in the consecutive sequence from FIG. 1 to FIG. 6), and just about to move into a position in which they will be parallel to planar opening 33 at the bottom of frame 26. In FIG. 9, the die plate and the die carried by it are shown just before they reach their forward, stamping position in which the operative surfaces of die 23 will extend slightly through planar opening 33 to contact the predetermined surface on which information is to be stamped. As will be seen from FIG. 8, die plate support leg 24 and the die plate are guided in this final downward movement perpendicular to planar opening 33 by the sides of cam slot 90 that lie on either side of segment 118 of cam slot center line 108. FIG. 1 shows the final, stamping position of the die plate to which die plate support leg 24 has moved vertically downward in a straight line in the final portion of its pivot from its retracted, inking position.

This final, vertically downward movement results in an even printing of the information on the predetermined surface. In addition, it reduces the likelihood of the pivoting die plate or the die carried by it or the die plate support legs protruding below planar opening 33 at the bottom of the frame base at the beginning of the die plate's upward movement, since the die plate's upward pivot is preceded by a straight, vertically upward movement before the die plate begins its actual pivot.

A similar movement of die plate 22 with respect to outer surface 44 of inking pad 42 occurs at the upper end of the pivot path of the die plate. Just before the die plate reaches its retracted, inking position, it moves upward from the position shown in FIG. 10 in a straight vertical line—perpendicular to planar opening 33 at the frame bottom—for a distance equal to third predetermined distance 126. During the movement of die plate 22 from the position shown in FIG. 10 vertically upward to the position shown in FIG. 6, the plane of die plate 22 is maintained substantially parallel to surface 44. As a result, die 23 carried by die plate 22 approaches inking surface 44 in an attitude substantially parallel to that surface.

The vertically upward movement of die plate 22 and die 23 carried by it that has just been described will be best understood by considering FIGS. 5, 10, 8 and 6 in that order. In FIG. 5, die plate 22 and die 23 carried by it are pivoting upward and are just about to move into a position in which they will be parallel to inking surface 44. In FIG. 10, the die plate and the die carried by it are shown just before they reach their retracted, inking position in which the operative surfaces of die 23 will be pressed firmly against the outer surface 44 of die pad 42. As will be seen from FIGS. 5, 10 and 6, die plate support leg 24 is guided in this final, vertically upward movement along the center line of cam slot 90. Specifically, die support leg 24 is guided along extension 130 of center line 108 of cam slot 90 by the portions of the sides of the cam slot that lie on opposite sides of straight center line segment 124. As has been noted above, center line segment 124, and thus the corresponding sides of cam slot 90, lie at an angle of about 36° to base reference line 82. Die plate support leg 24 has been rotated about 144° from its position in FIG. 1 or 8 (counterclockwise in these Figures) to its position in FIG. 10. From the position shown in FIG. 10, the die plate support leg and the die plate move straight upward in a vertical direction, for a distance that is substantially equal to third predetermined distance 126, into the retracted, inking position shown in FIG. 6.

This results in an even inking of the operative surfaces of die 23. In addition, it reduces the likelihood of the pivoting die plate or the die carried by it or the die plate support legs striking inking pad 42 at the beginning of the die plate's downward movement, since the die plate's downward pivot is preceded by a straight movement vertically downward before the die plate begins its actual pivot.

To sum up, as one moves from bottom portion 96 of each cam slot 90 to its outer end portion 92 adjacent remote edge 94 of the die plate support leg 24 in which it is located, center line 90 of the cam slot (a) moves away from base reference line 82, (b) then runs parallel to the base reference line for second predetermined distance 122 and (c) finally moves away from the base reference line again, first in a gradual curve and, for the last portion 124 of center line 108 adjacent the outer end of the cam slot, in a straight line for a distance at least equal to third predetermined distance 126. Portion 118 that runs parallel to base reference line 82 as just described is spaced from the base reference line by a distance approximately equal to the first predetermined distance between the center of pivot pin 70 and the longitudinal center line 80 of guide slot 36 in frame side wall 34, and portion 124 of the cam slot center line lies at an angle of about 36° to base reference line 82.

Angle of Tilt Of Inking Pad

In principle, the greater the angle at which inking pad 42 is tilted from the horizontal, the greater will be the savings in vertical and horizontal space within the housing or frame of the hand stamper of this invention. However, the basic construction of the hand stamper places certain restraints upon the maximum angle of tilt. The desired angle of tilt of the inking pad will also be affected by the dimension of die plate 22 measured from its front edge **22*a* to its back edge 22*b***.

In the self-inking hand stamper of this invention, satisfactory results are obtained when the angle at which outer surface 44 of inking pad 42 is tilted from a plane parallel to planar opening 33 defined by the bottom of the base of frame 26 falls in the range from about 25° to about 45°. The angle of tilt may be larger the narrower die plate 22 is, as measured from its front edge to its back edge. In a self-inking hand stamper, the maximum dimension for the die plate measured from its front edge to its back edge should not be more than about 7 cm. because of the difficulty in such a stamper of maintaining the operative surfaces of the die in a substantially flat plane if the indicated dimension is greater than that figure.

It has been found that the angle at which the inking pad is tilted should be about 25° for hand stampers in which the die plate measures about 7 cm. from its front edge to its back edge, and about 28° to about 35° for stampers in which the die plate measures about 5 cm. from its front edge to its back edge. The angle of tilt of 36° for the inking pad in the hand stamper disclosed in the Figures of the accompanying drawings is for a stamper in which the die plate measures about 2.5 cms. from its front edge to its back edge. For a stamper in which this dimension of the die plate measures about 2.25 cms., the angle of tilt for the inking pad should be about 40° to about 42°, and stampers in which the indicated dimension of the die plate is about 2 cms. should have an inking pad tilted at about 45°.

Second Embodiment Of Stamper Of This Invention

Figure 11:
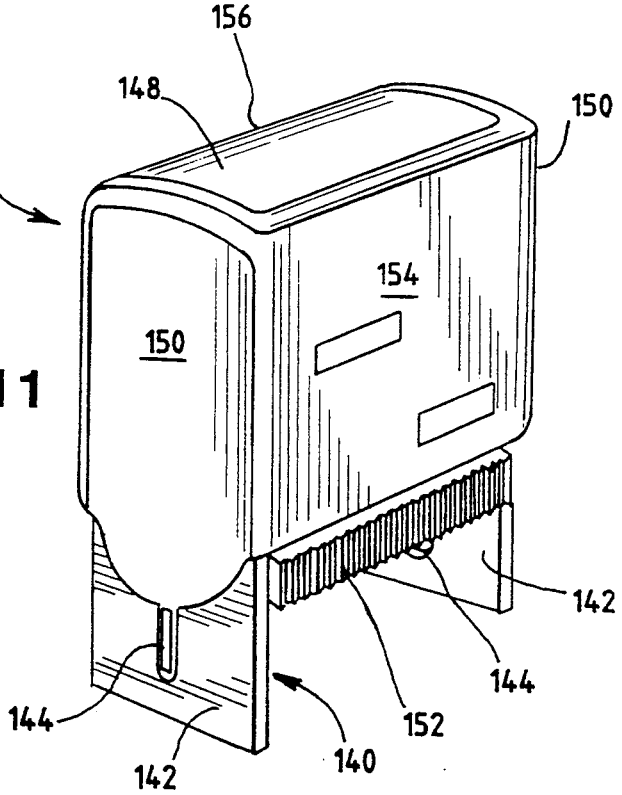
FIG. 11 is a perspective view of a second embodiment of the self-inking hand stamper of this invention.

FIG. 11 is a three-quarters perspective view of a second embodiment of the hand stamper of this invention in which the parts of the stamper are arranged to provide a still more compact device. In this stamper, frame 140 includes opposite side walls 142, each of which walls defines a vertical guide slot 144. Actuator 146 includes an easily gripped handle 148 and opposed downwardly extending yoke members 150. Fluted wall member 152 carries a tilted inking pad within the space defined by frame or housing 140. The various structural parts of this embodiment are formed of plastic.

The economical use of space within the housing of the stamper that is possible with a tilted die plate allows the inking pad to be pivoted through a path of significantly less than 180° from its retracted, inking position to its forward, stamping position without any impediment to that pivoting movement either from the front side wall 154 or from the opposing back wall 156 of the stamper.

While this invention has been described in connection with the best mode presently contemplated by the inventor for carrying out his invention, the preferred embodiments described and shown are for purposes of illustration only, and are not to be construed as constituting any limitation of the invention. Modifications will be obvious to those skilled in the art, and all modifications that do not depart from the spirit of the invention are intended to be included within the scope of the appended claims.

I claim:

1. In a self-inking hand stamper that includes:

a die plate for carrying a die that contains information to be transferred to a predetermined surface by stamping the information thereon, said die plate having a front edge, a back edge, two side edges and a back surface;

support legs for said die plate, one of said support legs extending perpendicularly from said die plate back surface at a location adjacent each of the side edges of the die plate, each of said support legs having two side edges and a third edge that is remote from the die plate;

a frame for containing the die plate in both its retracted, inking position in the upper portion of the frame and in its forward, stamping position at the base of the frame, the bottom of said frame base defining a planar opening through which the die carried by the die plate can contact the predetermined surface on which said information is to be stamped, said frame having two vertical side walls each of which defines a single, straight, vertical guide slot that is associated with a respective one of said die plate support legs, the outer edges of said frame side walls defining front and back boundary planes, respectively, for said frame;

inking means positioned within said frame above the die plate and facing downward toward the same;

an actuator having a handle extending above said frame, a yoke member attached to the bottom of the actuator and having a leg extending downward outside of said frame adjacent each side thereof;

spring biasing means for holding said actuator in its uppermost position until the handle is pushed downward by the user of the stamper;

means for guiding said actuator downward and upward, respectively, as the handle is pushed down and then released, and axle means operatively connected with each of said die plate support legs and with said downwardly extending yoke legs, said axle means being slidably journaled, for vertical downward and upward movement, in the guide slots in said frame side walls, the improvement which comprises:

(a) positioning said axle means between the side edges of each of said die plate support legs and adjacent the die plate, with a base reference line extending from the center of said axle means perpendicularly away from the die plate along each die plate support leg;

(b) fixedly securing a single pivot pin for each of said die plate support legs on the one of said frame side walls with which the support leg is associated, said pivot pin having a circular cross section, the center of said pivot pin being spaced a first predetermined distance from the longitudinal center line of the guide slot in said associated frame side wall, each of said pivot pins being spaced from the frame bottom a sufficient distance that the die plate and its support legs do not at any time protrude downward through said planar opening defined by the bottom of the frame base as the die plate and its support legs pivot upward from the forward, stamping position of the die plate toward its retracted, inking position;

(c) providing a single cam slot in each of said die plate support legs in which slot the pivot pin associated with said support leg is slidably journaled, the outer end portion of said cam slot being located adjacent the edge of the support leg that is remote from the die plate, and the inner end of said cam slot in each of said die plate support legs being located adjacent said axle means for the support leg, said cam slot being curved in outline for at least the major part of its length;

(d) slidably journaling said axle means only in said straight, vertical guide slots in the frame side walls; and (e) positioning said inking means so that it is tilted from a plane parallel to said planar opening that is defined by the bottom of the frame base, to bring the portion of the inking means that is on the opposite side of said guide slots from said pivot pins that are mounted on the side walls of the frame closer to the frame base than the other portion of the inking means is, said inking means being spaced above said pivot pins a sufficient distance that the die plate and its support legs are not impeded as they pivot upward from the forward, stamping position of the die plate and the die carried by it to the retracted, inking position of the die plate where the die comes into contact with the inking means, whereby the die plate, in moving upward from its forward, stamping position at the base of said frame to its retracted, inking position in the upper portion of the frame, pivots through an arc of substantially less than 180°.

2. The self-inking hand stamper of claim 1 in which each of said pivot pins mounted on a side wall of the frame is located substantially as close to said planar opening at the bottom of said frame as it can be without causing the die plate or its support legs or the die carried by the die plate to protrude outward through the plane of said opening as the die plate pivots upward from its forward, stamping position to its retracted, inking position.

3. The self-inking hand stamper of claim 1 in which:

(a) said axle means is located at the mid-point of each side wall of the frame, and (b) the distance from the center of said axle means to any point on said two side edges, or on said third, remote edge, of each of said die plate support legs is less than one-half the width of each of said side walls of the frame, whereby no part of said support legs comes into contact at any time with either of said front and back boundary planes that are defined by the edges of the side walls of the frame.

4. The self-inking hand stamper of claim 3 in which no part of the side edges of either of the die plate support legs extends substantially farther laterally of the die plate than the front edge or back edge, respectively, of the die plate with which the support leg is associated.

5. The self-inking hand stamper of claim 3 in which said axle means is located immediately adjacent the back surface of the die plate.

6. The self-inking hand stamper of claim 1 in which said inking means is located substantially as close to each of said pivot pins that are mounted on the side walls of the frame as it can be without impeding the die plate and its support legs and the die carried by the die plate as they pivot upward from the forward, stamping position of the die plate to the retracted, inking position of the die plate where said die comes into contact with the inking means.

7. The self-inking hand stamper of claim 1 in which each of said pivot pins mounted on a side wall of the frame is located at a smaller perpendicular distance from the bottom of the side wall on which it is mounted than it is from the outer surface of said tilted inking means.

8. The self-inking hand stamper of claim 1 in which:

(a) the bottom portion of the cam slot in each of the die plate support legs is substantially arcuate in outline, and (b) the distance between the center of curvature of said arcuate bottom portion and the center of said axle means for said die plate support legs is equal to said first predetermined distance between the center of said pivot pin on the frame side wall that is associated with the die plate support leg and the longitudinal center line of the guide slot in said frame side wall.

9. The self-inking hand stamper of claim 8 in which, when the die plate is in its forward, stamping position, the center of curvature of the arcuate bottom portion of each of said cam slots lies on a straight line that extends from the center of said axle means to the center of the pivot pin that is associated with the cam slot.

10. The self-inking hand stamper of claim 8 in which the distance between the center line of each of said cam slots and the base reference line that extends from the die plate along the die plate support leg in which the cam slot is located increases for the major part of the cam slot length as one moves away from the bottom portion of the cam slot to the outer end portion of the cam slot adjacent the remote edge of the die plate support leg.

11. The self-inking hand stamper of claim 10 in which the center line of the cam slot in each of the die plate support legs contains one segment that:

(a) is a straight line positioned perpendicularly to the die plate, and (b) when the die plate is in its forward, stamping position:

(i) passes through the center of the pivot pin that is journaled in the cam slot, and (ii) extends for a second predetermined distance from said pivot pin center toward the die plate, whereby just before the die plate reaches its forward, stamping position, it moves in a straight line perpendicular to said planar opening that is defined by the bottom of the frame base, with the plane of the die plate maintained substantially parallel to said planar opening, for a distance that is substantially equal to said second predetermined distance.

12. The self-inking hand stamper of claim 11 in which the portion of the center line of each of said cam slots that runs parallel to the base reference line that extends along the die plate support leg in which the cam slot is located is spaced from said base reference line by a distance equal to said first predetermined distance between the center of the pivot pin on the frame side wall that is associated with the die plate support leg and the longitudinal center line of the guide slot in said frame side wall.

13. The self-inking hand stamper of claim 10 in which the center line of the cam slot in each of the die plate support legs contains one segment that:

(a) is a straight line positioned at an angle to said base reference line that extends along the die plate support leg, which angle is substantially equal to the angle at which said inking means is tilted from a plane parallel to said planar opening defined by the bottom of said frame base, and (b) when the die plate is in its retracted, inking position:

(i) passes through the center of the pivot pin that is journaled in the cam slot, and (ii) extends from said pivot pin center, at the aforesaid angle to the base reference line, for a third predetermined distance;

whereby just before the die plate moves into its retracted, inking position it moves upward in a straight, vertical line, with the plane of the die plate maintained in a position substantially parallel to the surface of the inking means, for a distance that is substantially equal to said third predetermined distance.

14. The self-inking hand stamper of claim 1 in which the angle at which said inking means is tilted from a plane parallel to said planar opening defined by the bottom of said frame base falls in the range from about 25° to about 45°, with the angle being larger the narrower the die plate is, as measured from its front edge to its back edge.

15. The self-inking hand stamper of claim 14 in which the angle at which the inking means is tilted as there described is about 25° for hand stampers in which the die plate measures about 7 cm. from about its front edge to its back edge.

16. The self-inking hand stamper of claim 14 in which the angle at which the inking means is tilted as there described is from about 28° to about 35° for hand stampers in which the die plate measures about 5 cm. from its front edge to its back edge.

17. The self-inking hand stamper of claim 14 in which the angle at which said inking means is tilted as there described is about 36° for hand stampers in which the die plate measures about 2.5 cms. from its front edge to its back edge.

18. The self-inking hand stamper of claim 14 in which the angle at which the inking means is tilted as there described is from about 40° to about 42° for hand stampers in which the die plate measures about 2.25 cms. from its front edge to its back edge.

19. The self-inking hand stamper of claim 14 in which the angle at which the inking means is tilted as there described is about 45° for hand stampers in which the die plate measures about 2 cms. from its front edge to its back edge.

20. The self-inking hand stamper of claim 1 in which:

(a) each of said pivot pins mounted on the side walls of said frame is located substantially as close to said planar opening at the base of the frame as it can be without causing the die plate or its support legs or the die carried by the die plate to break through the plane of said opening as the die plate pivots upward from its forward, stamping position to its retracted, inking position.

(b) said axle means is located at the mid-point of each side wall of said frame, and the distance from the center of said axle means to any point on said two side edges, or on said third, remote edge of each of the side plate support legs is less than one-half the maximum width of each of said side walls of the frame;

(c) no part of the side edges of either of the die plate support legs extends substantially farther laterally than the front edge or back edge, respectively, of the die plate with which the support leg is associated;

(d) said inking means is located substantially as close to each of said pivot pins that are mounted on the side walls of side frame as it can be without impeding the die plate and its support legs as they pivot upward from the forward, stamping position of the die plate and the die carried by it to the retracted, inking position where said die comes into contact with the inking means;

(e) the bottom portion of the cam slot in each of the die plate support legs is arcuate in cross section, and the distance between the center of curvature of said arcuate bottom portion and the center of said axle means for said die plate support legs is equal to said first predetermined distance between the center of said pivot on the frame side wall that is associated with the die plate support leg and the longitudinal center line of the guide slot in said frame side wall;

(f) as one moves from the bottom portion of each of said cam slots to its outer end portion adjacent the remote edge of the die plate support leg in which it is located, the center line of the cam slot:

(i) moves away from the base reference line that extends from the die plate along the die plate support leg, (ii) then runs parallel to said base reference line for a second predetermined distance, and (iii) finally moves away from said base reference line again, first in a gradual curve and, for the last portion of the center line at the outer end of the cam slot, in a straight line for a third predetermined distance;

(g) the portion of the center line of each of said cam slots that runs parallel to the base reference line that extends along the die plate support leg in which the cam slot is located is spaced from said base reference line by a distance approximately equal to said first predetermined distance between the center of the pivot pin on said frame side wall that is associated with the die plate support leg and the longitudinal center line of the guide slot in the frame side wall; and (h) the angle at which said inking means is tilted from a plane parallel to said planar opening defined by the bottom of said frame base falls in the range from about 25° to about 45°, with the angle being larger the narrower the die plate is, as measured from its front edge to its back edge.

* * * * *